US006494568B2

(12) United States Patent
Hou et al.

(10) Patent No.: US 6,494,568 B2
(45) Date of Patent: Dec. 17, 2002

(54) INK CARTRIDGE WITH A PRESSURE ADJUSTING DEVICE

(75) Inventors: I-Chung Hou, Hsin-Chu (TW); Cheng-Wei Hsu, Yung-Kang (TW)

(73) Assignee: International United Technology Co., Ltd., Hsin-Chu Hsien (TW)

( * ) Notice: Subject to any disclaimer, the term of this patent is extended or adjusted under 35 U.S.C. 154(b) by 0 days.

(21) Appl. No.: 09/982,390

(22) Filed: Oct. 18, 2001

(65) Prior Publication Data

US 2002/0047883 A1 Apr. 25, 2002

(30) Foreign Application Priority Data

Oct. 20, 2000 (TW) ..... 89122058 A

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,453,772 A * 9/1995 Aono et al. ..... 347/87
5,719,609 A * 2/1998 Hauck et al. ..... 347/85
5,812,168 A 9/1998 Pawlowski, Jr. et al.
5,923,353 A * 7/1999 Boyd et al. ..... 347/85
5,988,803 A * 11/1999 Komplin et al. ..... 347/86
6,186,620 B1 * 2/2001 Hsieh et al. ..... 347/84
6,203,146 B1 3/2001 Pawlowksi, Jr. et al.
6,213,598 B1 4/2001 Hou et al.
6,250,747 B1 6/2001 Hanck
2001/0010531 A1 8/2001 Hsieh et al.

* cited by examiner

*Primary Examiner*—Anh T. N. Vo
(74) *Attorney, Agent, or Firm*—Winston Hsu

(57) ABSTRACT

An ink cartridge has a housing with an ink reservoir. The housing has a first vent, a second vent, and an opening. The ink reservoir has an air bag to adjust pressure within the ink reservoir. The ink cartridge further has an elastic restricting device that prevents ink in the ink reservoir from seeping through the opening. An elastic plug plugs the second vent of the housing, and an active shaft is movably installed in the well for pushing the elastic plug. When consumption of ink causes the air bag to expand to a predetermined degree, the air bag moves the active shaft, the active shaft pushes the elastic plug, and air enters into the ink reservoir through the second vent to reduce the volume of the air bag. When the air bag stops moving the active shaft, the elastic plug plugs the second vent.

10 Claims, 7 Drawing Sheets

INK CARTRIDGE WITH A PRESSURE ADJUSTING DEVICE

BACKGROUND OF THE INVENTION

1. Field of the Invention

The present invention relates to an ink cartridge used in an ink jet printing device, and more particularly, to an ink cartridge with an ability to adjust internal fluid pressure automatically.

2. Description of the Prior Art

As personal computers become more popular, ink jet printing devices are becoming a most common computer output/printing device used by people, families, and companies, because a price and a quality of the ink jet printers attract customers to buy.

A typical ink jet printing device has a printing head that moves along a track, back and forth, to print on a document. The printing head usually has at least an ink cartridge, and the ink cartridge comprises a housing with an ink reservoir for storing ink, and a print head connected to the ink reservoir to control the ink jetting. In a typical ink jet printing device, flow control is usually employed to control the ink jetting out to the document from the ink reservoir. Typical print head flow control mechanisms are divided into two types: thermal-bubbles and pressure-waves.

The thermal-bubbles print head comprises a thin-film resister. When the resistor is heated, a trace of ink vaporizes immediately, quickly expanding to make ink pass through the print head, and print on the document. Although the print head using the flow control can get ink from the ink reservoir and jet ink effectively, the flow control needs a controlling mechanism, so that the print head does not seep ink when not in use. The controlling mechanism usually provides a light negative pressure to prevent ink from seeping onto the print head. The negative pressure is partial vacuum in the ink cartridge, so that the external atmospheric pressure is slightly higher than the fluid pressure us in the ink cartridge. The negative pressure is indicated by a positive value, so an increase in the negative pressure means an increased vacuum of the ink cartridge, and a greater difference between the external atmospheric pressure and the fluid pressure in the cartridge. By increasing the negative pressure, ink is prevented from seeping from the print head.

Although increasing the negative pressure prevents ink from seeping out of the print head, the negative pressure has an upper limit. If the negative pressure is too high, ink cannot overcome the negative pressure and jet from the print head. On the other hand, the ink cartridge must be able to adjust the negative pressure in the ink reservoir automatically by changing the pressure of the surrounding environment to maintain a suitable range. For example, when the pressure of the surrounding environment decreases, the negative pressure causing ink not to seep through the print head is higher. Furthermore, the "operating-effect" of the ink reservoir also affects the negative pressure of the ink reservoir. For example, when the ink in the ink reservoir is continually consumed, the negative pressure of the ink reservoir increases. At this time, unless the negative pressure is adjusted appropriately, the print head ejects less ink, which affects the printing quality, such that the print head may not even jet ink any more.

In the prior art, the negative pressure of the ink reservoir is controlled by a "regulator" in the ink reservoir. The regulator is usually an elastic air bag. By stretching the elastic air bag between a maximum volume and a minimum volume, the volume of stored ink in the ink reservoir also changes to adjust to changes of the negative pressure. For example, when the pressure of the surrounding environment decreases, the negative pressure of the ink reservoir also decreases. At this time, the regulator starts to increase the volume used for storing ink in the ink reservoir. Therefore, the negative pressure is increased, and the ink does not seep.

A major shortcoming of the prior art elastic air bag regulator is that the maximum volume of the elastic air bag has limits. When ink is consumed to a predetermined degree, and the elastic air bag expands to the maximum volume, the volume of stored ink in the ink reservoir does not change any more. Continued reduction of ink volume causes the negative pressure to exceed the range, and the ink does not overcome the negative pressure to jet from the print head, such that the ink in the ink trough is not used completely and is wasted.

Another kind of prior art used to control the negative pressure in the ink trough is a bubble generator. As disclosed in U.S. Pat. No. 5,526,030, the bubble generator is set in the ink reservoir and has a jet hole through the housing of the ink cartridge. With the jet hole, external air can enter into the ink reservoir. The controlling mechanism in the bubble generator designed appropriately makes ink gather in the jet hole and utilizes the capillarity of ink to form a liquid seal. When the negative pressure of the ink reservoir rises to a predetermined degree, external air overcomes the liquid seal and enters into the ink reservoir as a bubble. Thus, the negative pressure of the ink reservoir decreases. Furthermore, as a result of the bubble entering into the ink reservoir and negative pressure reducing, the liquid seal of the jet hole rebuilds to prevent bubbles from continuing entering.

However, the bubble generator above uses surface tension of ink and static water pressure of ink to control bubbles entering into the ink reservoir. Therefore, the primary shortcomings of the prior art above are: 1.) When using different ink, the surface tension of ink is different, and the bubble generator needs to be redesigned; 2.) When remaining ink is reduced, static water pressure of the ink changes, and an pressure adjusting capability of the bubble generator is limited. 3.) For a negative pressure of the ink reservoir as bubbles enter being the designed value, the bubble generator must be designed precisely, increasing the difficulties of manufacturing and assembling.

SUMMARY OF THE INVENTION

It is therefore a primary objective of the present invention to provide an ink cartridge with an ability to adjust pressure automatically, regardless of atmospheric pressure effects.

According to the claimed invention, the ink cartridge comprises a housing with an ink reservoir for storing ink. The housing has a first vent, a second vent and an opening. The opening is installed at a bottom end of the housing and is connected to the ink reservoir. The ink cartridge further comprises an air bag installed in the ink reservoir and connected to the first vent. The first vent enables external air to enter the air bag, and the air bag adjusts pressure within the ink reservoir. An elastic restricting device is installed in the ink reservoir for restricting air in the air bag, to prevent the ink in the ink reservoir from seeping through the opening. An elastic plugging device elastically plugs the second vent of the housing. And, an active shaft is movably installed in the ink reservoir for pushing the elastic plugging device. Consumption of the ink in the ink reservoir causes the air bag to expand. When the air bag expands to a predetermined degree, the air bag moves the active shaft, the active shaft pushes the elastic plugging device, and air enters into the ink reservoir through the second vent to reduce the volume of the air bag. When the air bag stops moving the active shaft, the elastic plugging device elastically plugs the second vent.

It is an advantage of the claimed invention that the ink cartridge can adjust internal pressure within the ink reservoir.

These and other objectives and advantages of the present invention will no doubt become obvious to those of ordinary skill in the art after having read the following detailed description of the preferred embodiment that is illustrated in the various figures and drawings.

DETAILED DESCRIPTION OF THE PREFERRED EMBODIMENT

Figure 1:
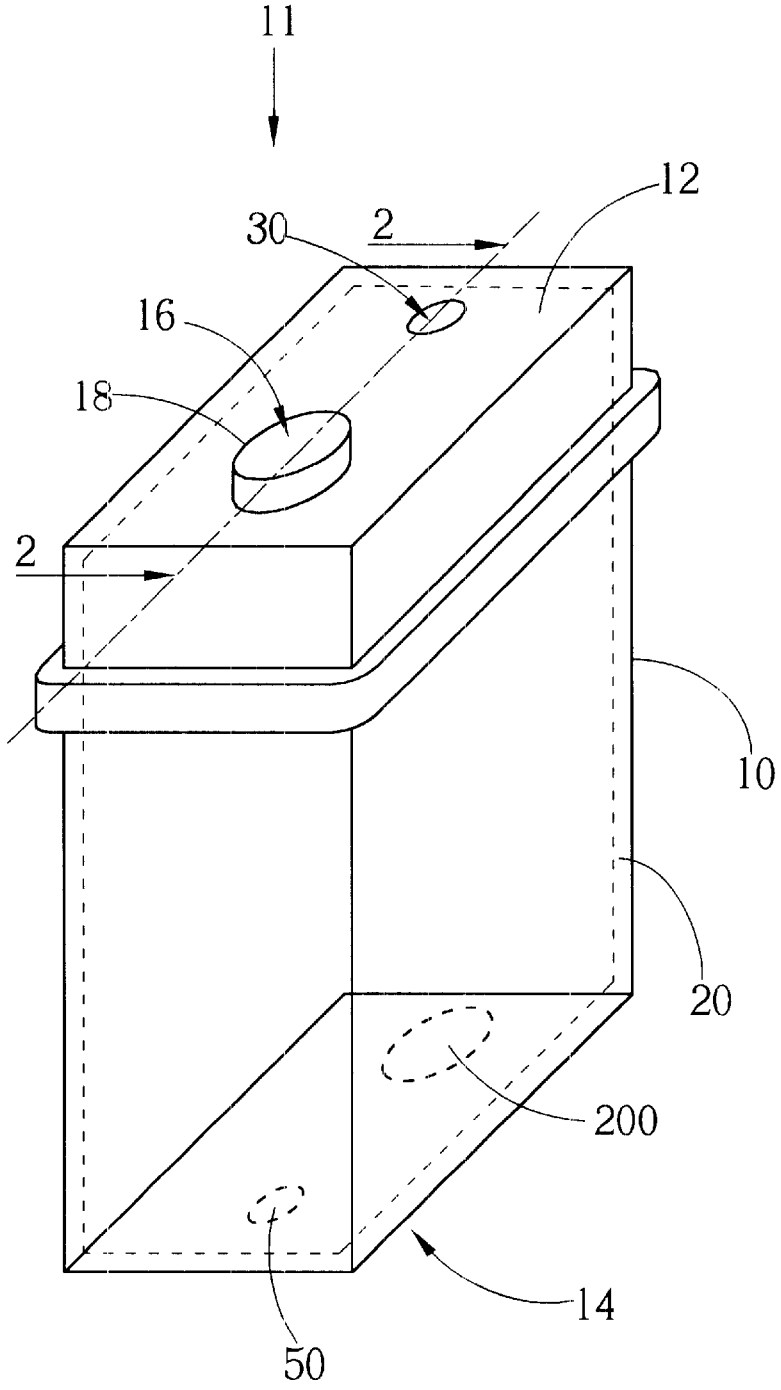
FIG. 1 is an overhead view of the present invention ink cartridge.

Please refer to FIG. 1. FIG. 1 is an overhead view of the present invention ink cartridge 11. The ink cartridge 11 comprises a housing 10 with an ink reservoir 20. A top 12 of the housing 10 has a first vent 30 and a ink-pour opening 16, and a bottom 14 of the housing 10 has a second vent 50 and an ink-exit opening 200. Ink stored in the ink cartridge 11 is poured in through the ink-pour opening 16. When the ink cartridge 10 is full of ink, there is a seal-up cover 18 to seal up the ink-pour opening 16. The ink cartridge 11 provides ink through the ink-exit opening 200. Additionally, the ink-exit opening 200 connects to an ink jet printing head and other relative circuitry used to control the ink jetting to print.

Figure 2:
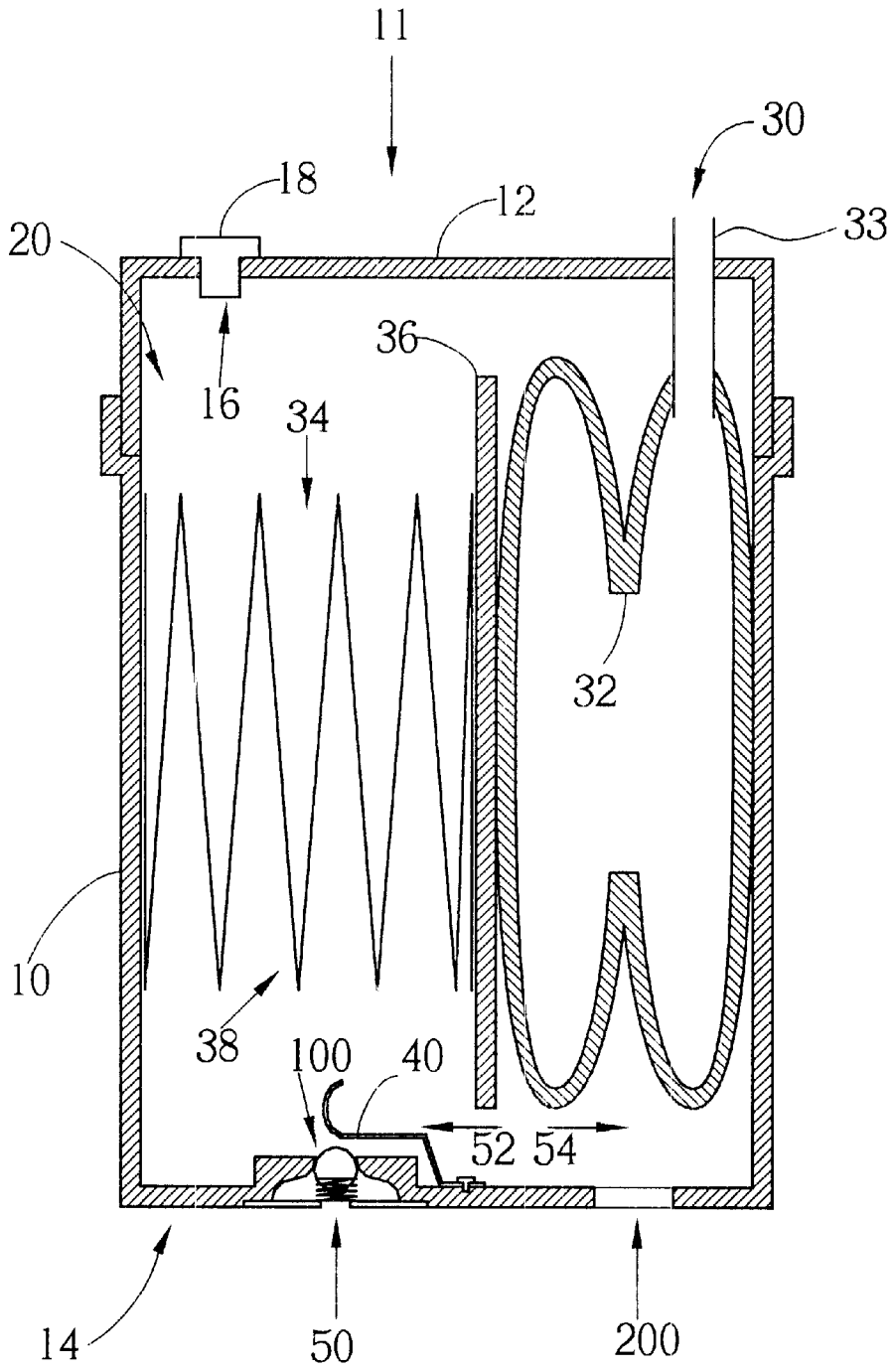
FIG. 2 is a cross-sectional diagram of the ink cartridge along a tangent 2—2 shown in FIG. 1.

Please refer to FIG. 2. FIG. 2 is a cross-sectional diagram of the ink cartridge 11. As above, the present invention ink cartridge 11 uses the housing 10 to cover the ink reservoir 20 and provides ink through the ink-exit opening 200. To prevent ink seeping from the ink-exit opening 200 when not supplying ink, the ink reservoir 20 must keep a predetermined negative pressure. As mentioned above, although there are several prior art mechanisms to keep negative pressure, they all have shortcomings. To overcome the shortcomings of the prior art, the present invention ink cartridge 11 uses a new negative pressure control mechanism. The negative pressure control mechanism comprises an air bag 32, an elastic restricting device 34, an active shaft 40, and an elastic plugging device 100. The air bag 32 is a seal-up hollow bag and is isolated from the fluid in the ink reservoir 20. It connects to a first vent 30 of the top 12 of the housing 11 only by a first ventilated pipe 33, so that external air can pass in and out of the air bag 32. The elastic restricting device 34 comprises a press board 36 and a first spring 38. One end of the first spring 38 is fixed on a wall of the housing 10, and the other end is fixed on the press board 36, so that the spring 38 presses the air bag 32 through the press board 36. The active shaft 40 is fixed on the bottom of the housing 14, and it is an elastic element. The detailed structure of the elastic plugging device 100 is shown in FIG. 3.

Figure 3:
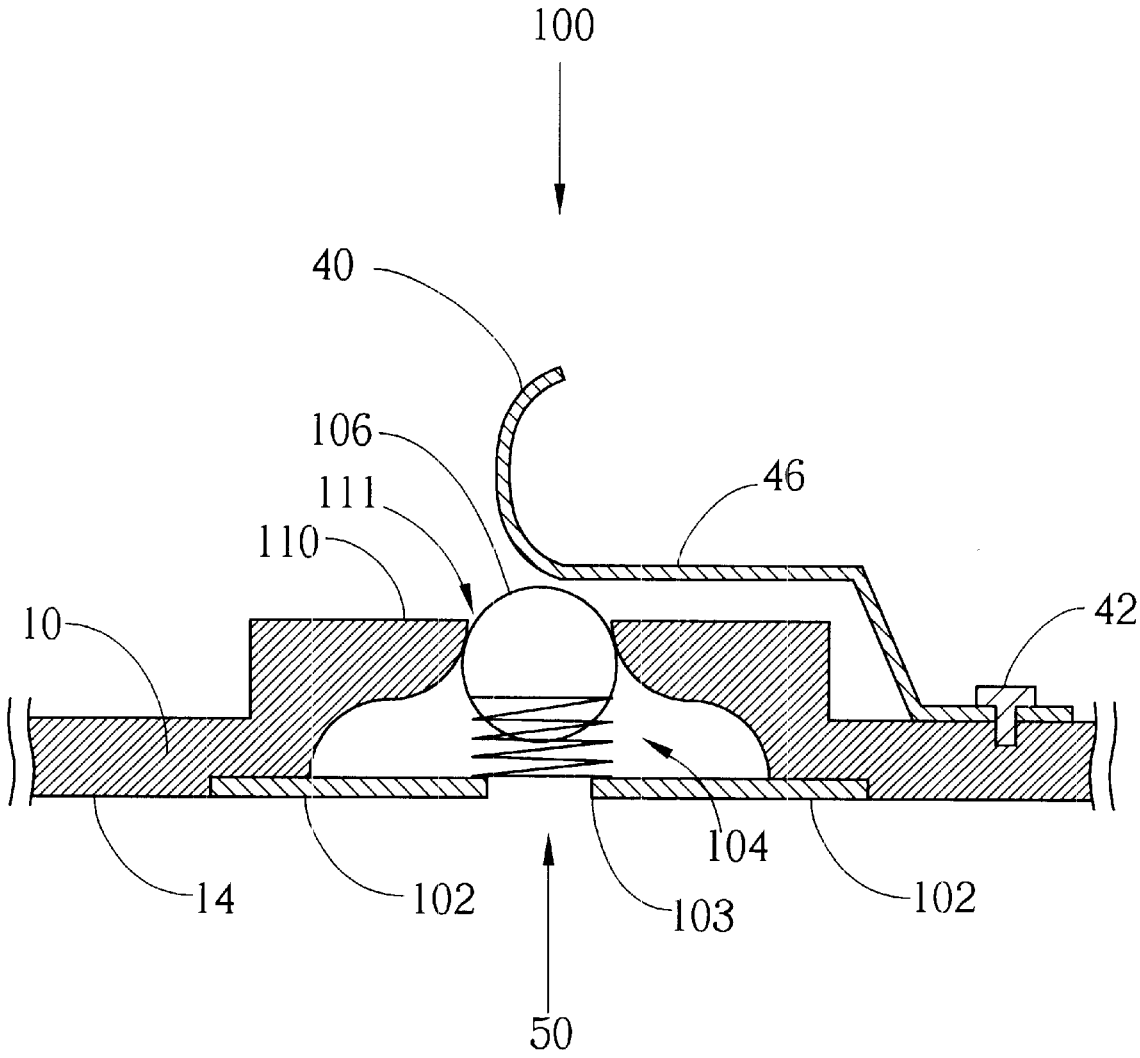
FIG. 3 is a structural diagram of an elastic plugging device and an active shaft shown in FIG. 2.

Please refer to FIG. 3. FIG. 3 is a detailed structural diagram of the elastic plugging device 100. The elastic plugging device 100 is set in the ink reservoir 20 and on the bottom of the housing 14 of the present invention ink cartridge 11 to control the switch of the second vent 50. The elastic plugging device 100 comprises a flat panel 102, a second spring 104, and a spherically shaped plug 106. The flat panel 102 is fixed on the housing 10 and has a round hole 103. The second spring 104 is fixed on the flat panel 102 to elastically support the spherically shaped plug 106. The housing 10 forms a projective edge 110 around the second vent 50. The projective edge 110 surrounds the second vent 50 to form around hole 111 smaller than the spherically shaped plug 106 to limit the position of the spherically shaped plug 106. Please note that the spherically shaped plug 106 is not fixed on the projective edge 110, and it is only pasted tightly on the projective edge 110 by the upward thrust of the second spring 104. FIG. 3 also shows relative positions of the active shaft 40 and the elastic plugging device 100. The active shaft 40 is fixed on the housing 10 with a fixing latch and extends to the spherically shaped plug 106 of the elastic plugging device. In a situation where the active shaft 40 lacks an external force, the horizontal section 46 of the active shaft keeps a fixed distance with the spherically shaped plug 106, and both do not make contact. Therefore, the spherically shaped plug 106 is only pasted tightly on the projective edge 110 by the upward thrust of the second spring 104, and thus seals up the second vent 50.

The working principle of keeping the negative pressure in the present invention ink cartridge 11 is described below. Please refer to FIG. 2 again. When the ink cartridge 11 is full of ink, the air bag 32 is pressed to the right wall of the ink reservoir 20 along a direction 54 (i.e. the right direction of the figure) by the first spring 38 of the elastic restricting device 34. Please note that the press board 36 is not in contact with the active shaft 40. By transferring the ink in the ink cartridge 11 to the printing head through the opening 200, the vacuum degree of the ink reservoir 20 also raises. At this time, the air bag 32 expands because of inhaling external atmosphere through the first vent 30 to make up for the vacuum left by consumed ink in the ink reservoir 20. As the air bag 32 expands along a direction 52 (i.e. the left direction of the figure) by ink consumption, the first spring 38 of the elastic restricting device 34 continuously exerts pressure upon the air bag 32 through the press board 36 along a direction 54 to appropriately restrict the expansion of the air bag 32, so that the ink reservoir 20 keeps an appropriate negative pressure.

Figure 4:
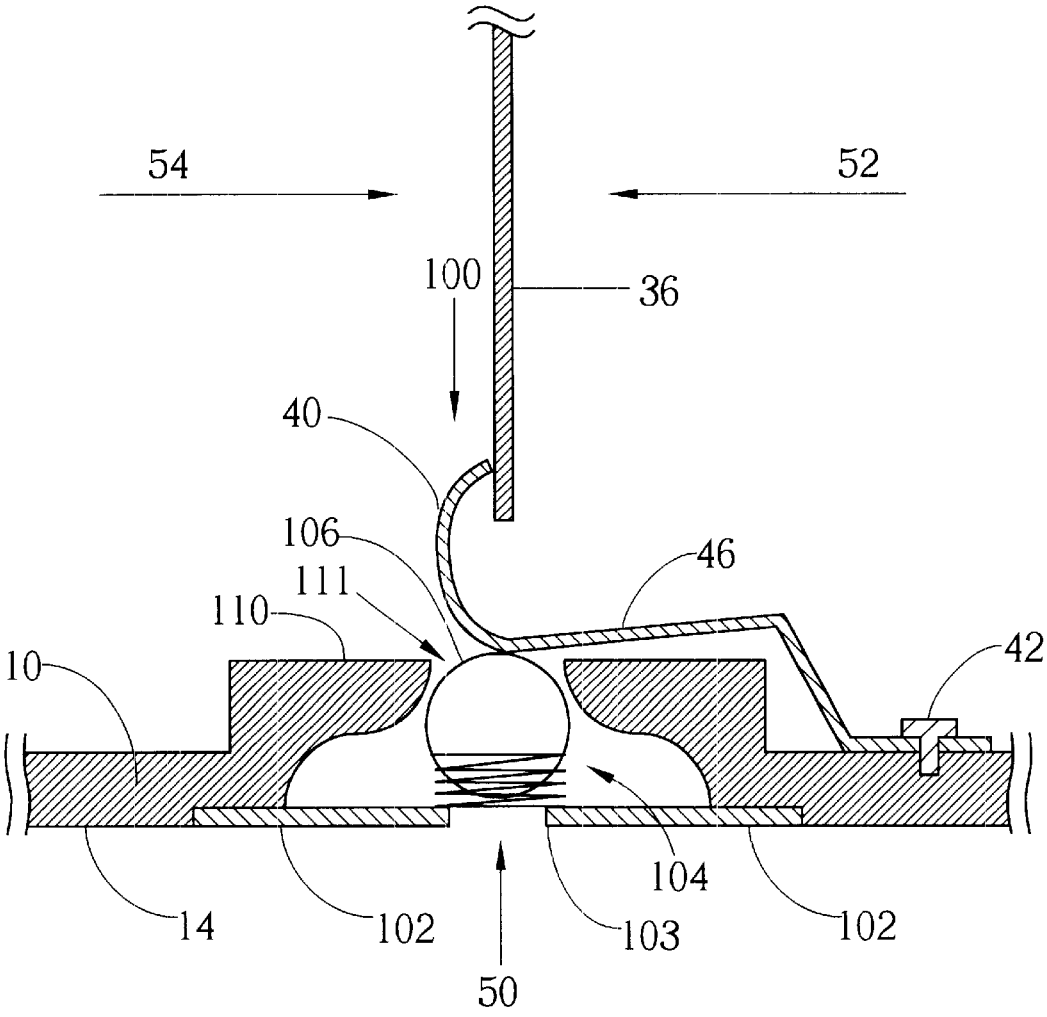
FIG. 4 is a diagram of the elastic plugging device operated by an active shaft to open a second vent of the present invention cartridge.

By consuming more ink of the ink reservoir 20, the air bag 32 expands along the direction 52 and pushes the press board 36 toward the left of the figure. When the air bag 32 expands to a predetermined degree, the press board 36 contacts and pushes the active shaft 40 to trigger the elastic plugging device 100. Please refer to FIG. 4 for more detailed information. FIG. 4 is a diagram of the elastic plugging device 100 being triggered by the active shaft 40. When the air bag 32 expands to a predetermined degree, the press board 36 is pushed to the left of the figure along the direction 52 until the active shaft 40 is contacted and pushed. At this time, the elastic active shaft 40 composed of reeds is bent downward by the thrust of the press board 36 along the direction 52, and the horizontal section 46 of the active shaft 40 presses the spherically shaped plug 106 downward. After the spherically shaped plug 106 is pressed downward to leave the projective edge 110, the spherically shaped plug 106 and the projective edge 110 are not closely contacted anymore, and a channel allowing external atmospheric air to enter appears. The external atmospheric air enters the ink reservoir 20 from the second vent 50 through the round hole 103 of the flat panel 102 and the round hole 111 of the projective edge 110 to fill in the vacuum of the ink reservoir 20 because of ink consumption. By the external atmospheric air entering into the ink reservoir 20 through the second vent 50, the fluid pressure in the ink reservoir (i.e. the total pressure of the air and ink in the ink reservoir) gradually increases, and the resistance of the air bag 32, which expands along the direction 52, against the press board is higher. Finally, the force generated by the gradually increasing fluid pressure, as external atmospheric air enters, and by the elastic restricting device 34 in the ink reservoir 20, along the direction 54, exceeds the expanding force of the air bag 32, along the direction 52, and the press board 36 is pushed to the right of the figure, along the direction 54, and leaves the active shaft 40. After the force acting on the active shaft 40 by the press board 36 disappears, the elasticity of the active shaft restores the horizontal section 46 of the active shaft to horizontal, and stops pressing the spherically shaped plug 111 downward. The upward elasticity of the second spring 104 presses the spherically shaped plug 106 to tightly seal the projective edge 110 again, to seal the second vent 50. The entire elastic plugging device 100 is also restored to the status in FIG. 3, i.e. the active shaft 40 does not receive any force, and the spherically shaped plug 106 tightly seals the projective edge 110 to seal the second vent 50. If ink is consumed, such that the air bag 32 expands to a predetermined degree again, the above process of opening/closing the second vent happens repeatedly until the ink is exhausted.

In short, the main spirit of the present invention ink cartridge 11 is controlling the elastic plugging device 100 to open or close the second vent 50 with the air bag 32 through the press board 36 and the active shaft 40 to maintain the negative pressure of the ink reservoir 20. In the prior art method of maintaining the negative pressure of the ink reservoir with the air bag, the vacuum in the ink reservoir because of the ink being consumed is filled up with the air bag. However, the volume of the air bag is limited. When the air bag expands to the maximum volume, the function of adjusting the negative pressure cannot be produced any longer. In the present invention ink cartridge 11, the vacuum in the ink reservoir due to the ink consumption is not only filled up by the air bag 32, but opening the second vent 50 by the elastic plugging device 100 to import external atmospheric air also balances the vacuum in the ink reservoir 20. Therefore, the present invention ink cartridge can continuously maintain the stability of the negative pressure until ink is exhausted.

The prior art bubble-generator as disclosed in U.S. Pat. No. 5,526,030 also uses a controlling mechanism to control an import air vent opening to import external atmospheric air to maintain the negative pressure of the ink reservoir. However, the operating key of the controlling mechanism relates to the surface tension and the static water pressure of the ink. The structure is precise and complicated, and increases the difficulty of production and manufacturing. If the types of ink filled in the ink cartridge are different, the controlling mechanism must be redesigned because the surface tensions of the ink are also different. Furthermore, as ink is consumed, the static pressure of the ink decreases. Once reduced to a particular degree, the controlling mechanism loses efficacy. In contrast with the negative pressure maintaining mechanism of the prior art ink cartridge, the air bag 32 engages with the active shaft 40 through the press board 36 to control the elastic plugging device 100 to open or prevent the external atmospheric air entering into the ink reservoir 20 through the second vent 50. The key of the controlling mechanism is the fluid pressure of the ink reservoir. Therefore, the negative pressure mechanism of the present invention ink cartridge can continuously work until ink is exhausted, and it does not need to be redesigned or remanufactured depending on the type of ink used. Furthermore, the structure of the negative pressure keeping mechanism of the present invention ink cartridge is simple, small, and easy to produce, manufacture,and assemble. It is better than the prior art.

The negative pressure maintaining mechanism of the present invention ink cartridge further includes a double protecting mechanism to maintain the closed state of the second vent. Please refer to FIG. 3 again. Please note that the negative pressure maintaining mechanism of the present invention ink cartridge comprises two elastic components, one is the active shaft 40, and the other elastic component is the second spring 104 pressing the spherically shaped plug 106 to tightly seal the projective edge 110. If the external atmosphere changes frequently, in the process of maintaining the negative pressure by the active shaft 40, the press board 36 pushes repeatedly. If the active shaft 40 is worn down because of the repeated operations, or the external atmosphere changes violently, so that the press board 36 pushes the active shaft 40 violently, the active shaft may be deformed forever and lose elasticity. Even if the press board 36 leaves the active shaft 40, the horizontal section 46 of the active shaft 40 still cannot restore a horizontal state, and continuously contact with the spherically shaped plug. At this time, the second spring 104 supporting the spherically shaped plug 106 functions to double protect and push the spherically shaped plug 106 upward to tightly seal the projective edge 110 and seal up the second vent 50. If not for the second spring 104, the active shaft, losing elasticity, continuously presses the spherically shaped plug 106 downward, and the second vent 50 cannot be sealed to let the external atmosphere enter continuously. Finally, the negative pressure cannot be kept, and the ink seeps from the second vent 50. The second spring 104 of the elastic plugging device 100 in the present invention ink cartridge 11 avoid this shortcoming completely.

Figure 5:
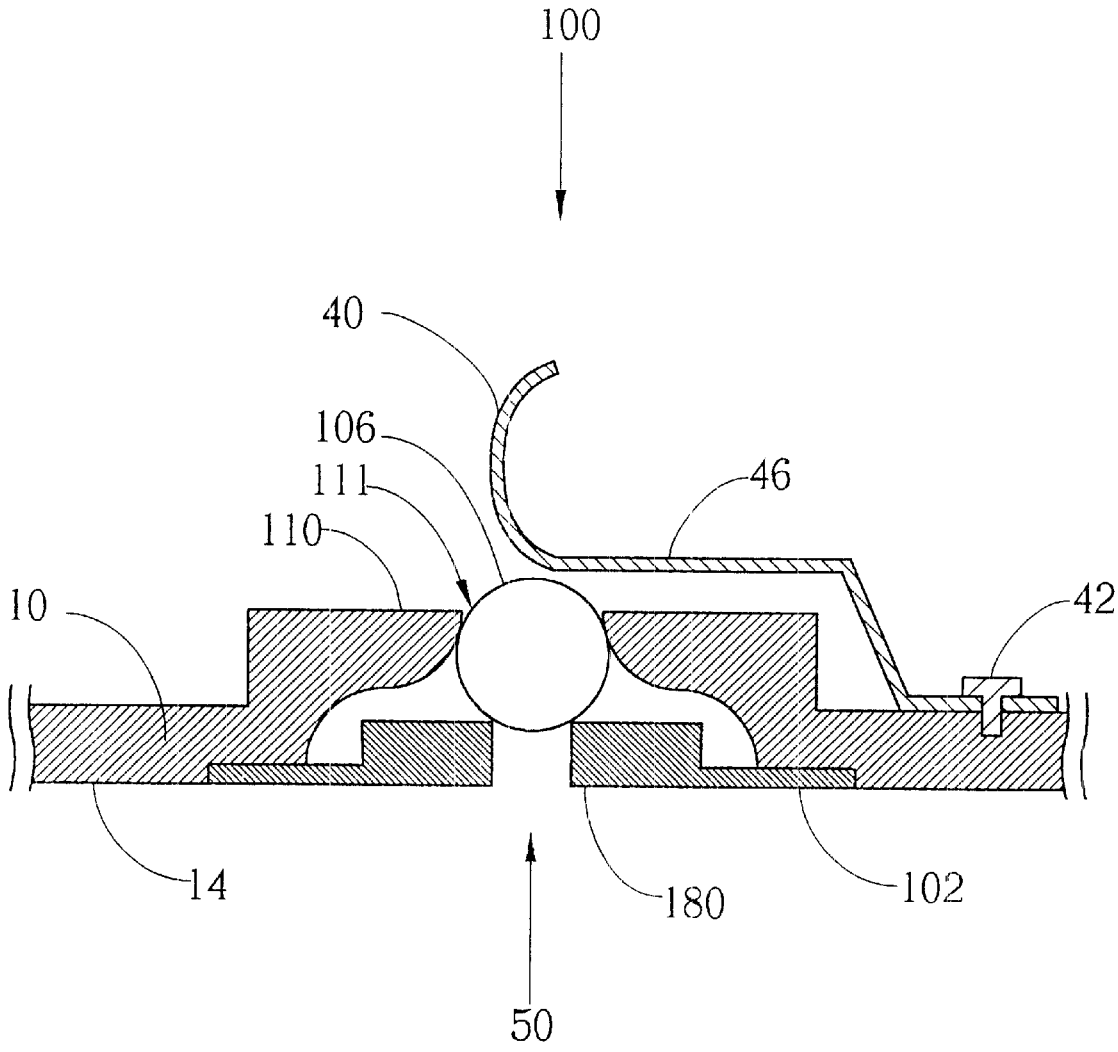
FIG. 5 is a diagram of the elastic plugging device of a second preferred embodiment of the present invention cartridge.

Please refer to FIG. 5. FIG. 5 is a diagram of the elastic plugging device 100 of a second preferred embodiment of the present invention. Specifically, the bottom panel 102 and the second spring 104 are replaced with a monolithically elastic bottom panel 180 in the preferred embodiment. Like the second spring 104 of the first preferred embodiment, the elastic bottom panel 180 elastically supports the spherically shaped plug 106. In the situation of the elastic plugging device 100 not exerting force, the second vent 50 is sealed.

Figure 6:
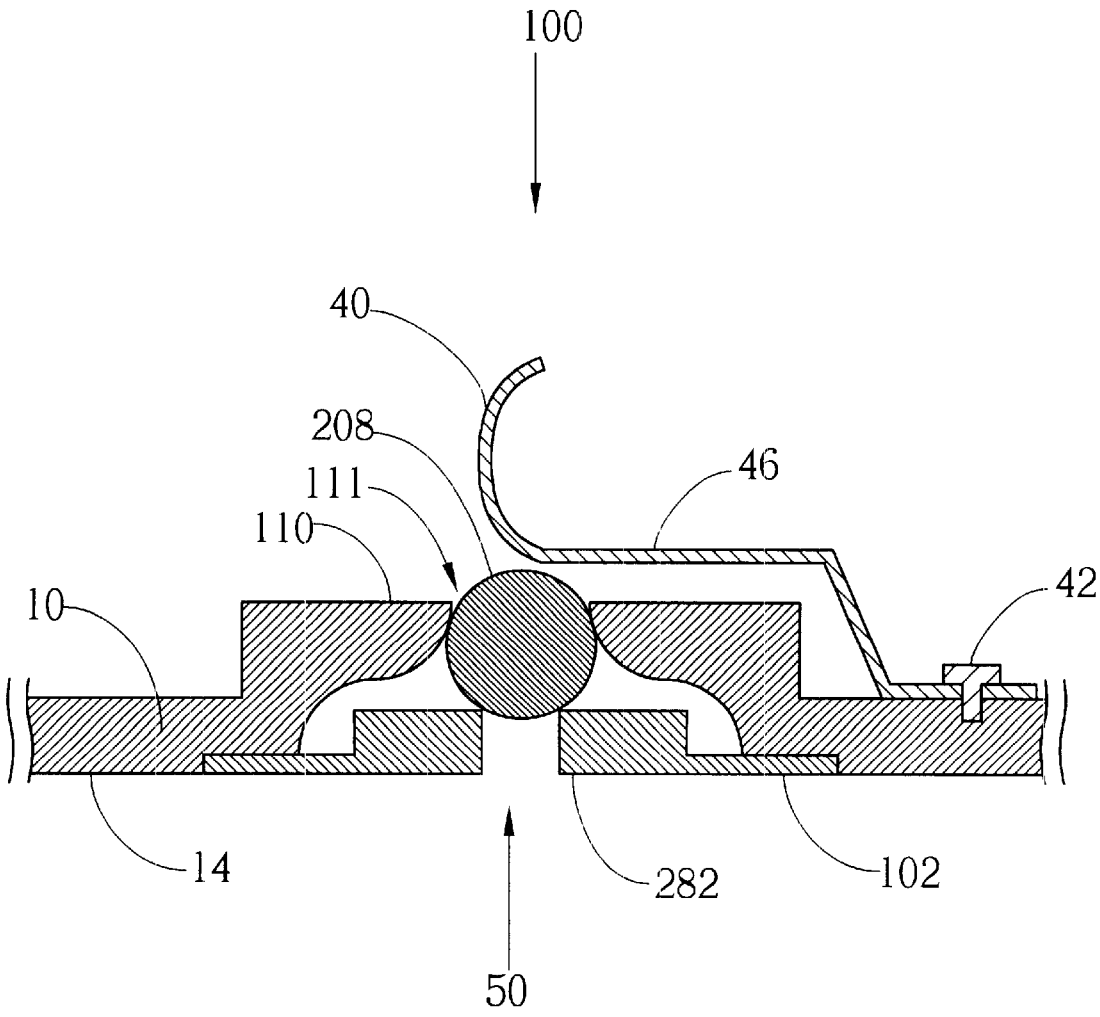
FIG. 6 is a diagram of the elastic plugging device of a third preferred embodiment of the present invention cartridge.

Please refer to FIG. 6. FIG. 6 is a diagram of the elastic plugging device 100 of a third preferred embodiment of the present invention. In the preferred embodiment, the spherically shaped plug 208 is an elastic, spherically shaped plug that tightly presses against the projective edge 110 to seal the second vent 50 with a hard bottom panel 282. When the active shaft pushed by the press board 36 presses the spherically shaped plug 208 downward, the spherically shaped plug 208 maintains a gap to allow the external atmospheric air to enter the ink reservoir from the round hole 111 of the projective edge 110 as a result of deformation.

Figure 7:
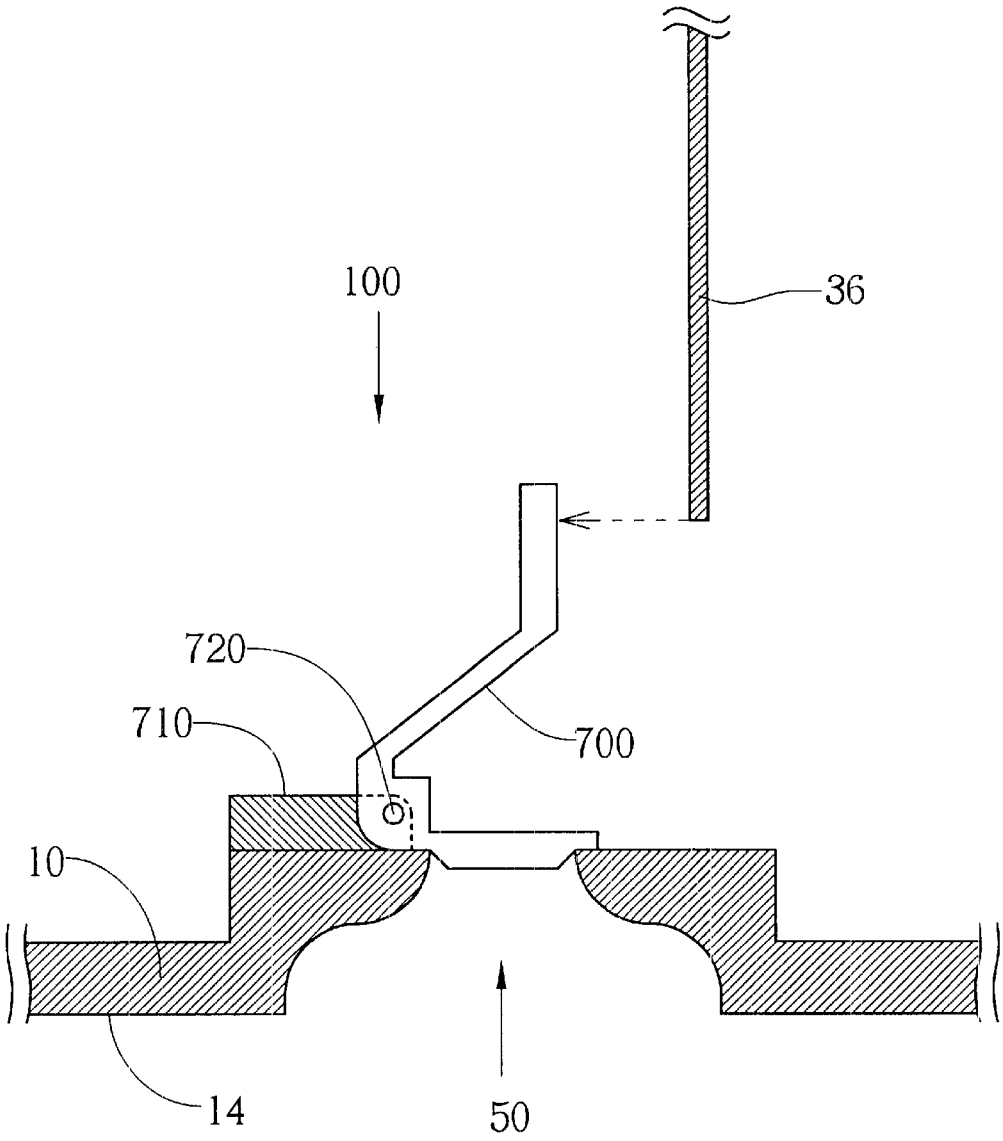
FIG. 7 is a diagram of the elastic plugging device of a fourth preferred embodiment of the present invention cartridge.

Please refer to FIG. 7. FIG. 7 is a diagram of the elastic plugging device 100 of a fourth preferred embodiment of the present invention. In this preferred embodiment, the active shaft, which seals up the spherically shaped plug of the second vent 50 and triggers the plastic plugging device, is replaced by a monolithically plugging cover 700. The plugging cover has a rotating axis 720, in which is installed a shearing stress spring 730 (not shown in FIG. 7), through a hole of the projective edge 710 corresponding to the axis 720, to elastically connect the plugging cover 700 to the housing 10. When the plugging cover 700 is not triggered by the press board 36, the shearing stress spring 730 adds a shearing stress on the plugging cover 700 in a clockwise direction, with 720 acting as the axis, so that the plugging cover 700 tightly presses the second vent 50 and seals it. When the press board 36 is pushed to the left (relative to the figure) by expansion of the air bag 32, the press board 36 causes the plugging cover 700 to rotate anticlockwise around the axis 720, so that the external atmospheric air enters from the second vent 50 to adjust the negative pressure of the ink reservoir 20.

The basic spirit of the above mentioned preferred embodiments of the present invention is using the air bag 32 to control the elastic plugging device 100 to open or close the second vent 50 through the active shaft and adjust the negative pressure of the ink reservoir 20. When the elastic plugging device 100 is not triggered by the active shaft, the elastic design of the elastic plugging device 100 can force sealing of the second vent. When ink is consumed in the well 20, the air bag 32 expands. When the air bag 32 expands to a predetermined degree, the air bag 32 triggers the elastic plugging device 100, through the press board 36 or the active shaft 40, and opens the second vent 50 to import the external atmospheric air to increase the fluid pressure in the well and keep the stability of the negative pressure. After the prior art air bag expands to a predetermined degree, it is no longer able to develop the function of keeping the negative pressure.

After the present invention air bag expands to a predetermined degree, importing the external atmospheric air to help maintain the negative pressure. This overcomes the shortcoming of the prior art air bag. Furthermore, with the prior art bubble generator, the triggering mechanism relates to the surface tension and the static water pressure of the ink. The structure is too complex and increases the difficulty of producing and manufacturing. The design lacks of elasticity and has to change with different kinds of ink. The operations are unavoidably affected by the operation of the ink cartridge. In contrast, the present invention ink cartridge uses the expanding of the air bag to trigger the elastic plugging device. The design is succinct, well-executed, easy to produce, assemble, and manufacture. Different kinds of ink and operation effects of the ink cartridge do not influence operation of the present invention. Finally, the elastic design of the elastic plugging device 100 of the present invention ink cartridge maintains sealing of the second vent 50, even if the active shaft 40 loses efficacy and continuously triggers the elastic plugging device 100. Operation is not affected by errors of the active shaft 40.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink cartridge comprising:

a housing with an ink reservoir for storing ink, the housing having a first vent, a second vent and an opening, the opening installed at a bottom end of the housing and connected to the ink reservoir;

an air bag installed in the ink reservoir and connected to the first vent, the first vent enabling external air to enter into the air bag, the air bag adjusting internal pressure within the ink reservoir;

an elastic restricting device installed in the link reservoir for restricting the expansion of the air bag so that the ink reservoir keeps a fixed negative pressure to prevent the ink in the ink reservoir from seeping through the opening;

an elastic plugging device for elastically plugging the second vent of the housing; and an active shaft movably installed in the ink reservoir for pushing the elastic plugging device away from the second vent to prevent the elastic plugging device from elastically plugging the second vent of the housing;

wherein consumption of the ink in the ink reservoir causes the air bag to expand, and when the air bag expands to a predetermined degree, the air bag causes the active shaft to push the elastic plugging device away from the second vent so that air enters into the ink reservoir through the second vent to reduce the volume of the air bag, and when the air bag stops causing the active shaft to push the elastic plugging device, the elastic plugging device elastically plugs the second vent.

2. The ink cartridge of claim 1 wherein the elastic plugging device comprises a spherically shaped plug and a spring for elastically pushing the spherically shaped plug to the second vent to plug the second vent, and when the air bag moves the active shaft, the active shaft pushes the spherically shaped plug out of the second vent so that air enters into the ink reservoir through the second vent.

3. The ink cartridge of claim 2 wherein the active shaft is an elastic element installed in the ink reservoir, and when the air bag expands to the predetermined degree, the air bag pushes the elastic element so that the elastic element pushes the spherically shaped plug out of the second vent, and when the air bag contracts, the elastic element returns to an original form, and the spring elastically pushes the spherically shaped plug to the second vent to plug the second vent.

4. The ink cartridge of claim 1 wherein the elastic plugging device comprises a rotating shaft rotatably fixed in the ink reservoir of the housing, the rotating shaft comprising a plug for plugging the second vent, the elastic plugging device further comprising a spring for elastically pushing the plug of the rotating shaft to the second vent to plug the second vent, and when the air bag moves the active shaft, the active shaft pushes the plug of the rotating shaft out of the second vent so that air enters into the ink reservoir through the second vent.

5. The ink cartridge of claim 4 wherein the active shaft is monolithically installed on one end of the rotating shaft, and when the air bag contracts, the a spring elastically pushes the plug of the rotating shaft to the second vent to plug the second vent and pushes the active shaft back to an original position.

6. An ink cartridge comprising:

a housing with an ink reservoir for storing ink, the housing having a first vent and a second vent;

a printing head installed at a bottom end of the housing and connected to the ink reservoir;

an air bag installed in the ink reservoir and connected to the first vent, the first vent enabling external air to enter into the air bag, the air bag adjusting internal pressure within the ink reservoir;

an elastic restraining device installed in the ink reservoir for restraining the expansion of air in the air bag so that the ink reservoir keeps a fixed negative pressure to prevent the ink in the ink reservoir from seeping through the printing head;

an elastic plugging device for elastically plugging the second vent of the housing; and an active shaft movably installed in the ink reservoir for pushing the elastic plugging device away from the second vent to prevent the elastic plugging device from elastically plugging the second vent of the housing;

wherein consumption of the ink in the ink reservoir causes the air bag to expand, and when the air bag expands to a predetermined degree, the air bag moves the active shaft, the active shaft pushes the elastic plugging device away from the second vent and air enters into the ink reservoir through the second vent to reduce the volume of the air bag, and when the air bag stops moving the active shaft, the elastic plugging device elastically plugs the second vent.

7. The ink cartridge of claim 6 wherein the elastic plugging device comprises a spherically shaped plug and a spring for elastically pushing the spherically shaped plug to the second vent to plug the second vent, and when the air bag moves the active shaft, the active shaft pushes the spherically shaped plug out of the second vent so that air enters into the ink reservoir through the second vent.

8. The ink cartridge of claim 7 wherein the active shaft is an elastic element installed in the ink reservoir of the housing, and when the air bag expands to the predetermined degree, the air bag pushes the elastic element so that the elastic element pushes the spherically shaped plug out of the second vent, and when the air bag contracts, the elastic element returns to an original form, and the elastic element elastically pushes the spherically shaped plug to the second vent to plug the second vent.

9. The ink cartridge of claim 6 wherein the elastic plugging device comprises a rotating shaft rotatably fixed in the ink reservoir of the housing, the rotating shaft comprising a plug for plugging the second vent, the elastic plugging device further comprising a spring for elastically pushing the plug to the second vent to plug the second vent, and when the air bag moves the active shaft, the active shaft pushes the plug out of the second vent so that air enters into the ink reservoir through the second vent.

10. The ink cartridge of claim 9 wherein the active shaft is monolithically installed on one end of the rotating shaft, and when the air bag contracts, the spring elastically pushes the plug to the second vent to plug the second vent and pushes the active shaft back to an original position.

* * * * *